US009647336B2

(12) United States Patent
Legay et al.

(10) Patent No.: US 9,647,336 B2
(45) Date of Patent: May 9, 2017

(54) RECONFIGURABLE RADIATING PHASE-SHIFTING CELL BASED ON COMPLEMENTARY SLOT AND MICROSTRIP RESONANCES

(75) Inventors: Herve Legay, Plaisance du Touch (FR); Etienne Girard, Tournefeuille (FR); Daniele Bresciani, Toulouse (FR); Raphael Gillard, Rennes (FR); Hassan Salti, Grenoble (FR); Tony Makdissy, Rennes (FR); Erwan Fourn, Rennes (FR)

(73) Assignees: Thales, Courbevoie (FR); Institut National Des Sciences Appliquees De Rennes, Rennes (FR); Centre National De La Recherche Scientifique, Paris (FR)

( * ) Notice: Subject to any disclaimer, the term of this patent is extended or adjusted under 35 U.S.C. 154(b) by 980 days.

(21) Appl. No.: 13/618,506

(22) Filed: Sep. 14, 2012

(65) Prior Publication Data

US 2013/0241770 A1 Sep. 19, 2013

(30) Foreign Application Priority Data

Sep. 14, 2011 (FR) ..... 11 02786

(51) Int. Cl.
*H01Q 15/02* (2006.01)
*H01Q 3/36* (2006.01)
*H01Q 3/46* (2006.01)

(52) U.S. Cl.
CPC ..... *H01Q 3/36* (2013.01); *H01Q 3/46* (2013.01)

(58) Field of Classification Search
CPC ..... H01Q 3/36; H01Q 3/46
(Continued)

(56) References Cited

U.S. PATENT DOCUMENTS 6,538,621 B1 * 3/2003 Sievenpiper ..... H01Q 9/0442 343/700 MS
7,358,915 B2 4/2008 Legay et al.
(Continued)

FOREIGN PATENT DOCUMENTS

EP 2 175 523 A1 4/2010
FR 2868216 A1 9/2005

OTHER PUBLICATIONS

Kokusho Sha, et al., "Characteristics of New Type of Quasi-Optical Diplexers", Electronics and Communications in Japan, Part 1—Communications, Dec. 1, 1986, pp. 90-99, vol. 69, No. 12, Wiley, Hoboken, NJ, USA, XP002141598.

*Primary Examiner* — Dameon E Levi
*Assistant Examiner* — Hasan Islam
(74) *Attorney, Agent, or Firm* — Baker Hostetler LLP

(57) ABSTRACT

A radiating phase-shifting cell is designed to favour the excitation of an equivalent resonance of the "slot" type in a first part of the phase cycle, and to favour an equivalent resonance of the "microstrip" type in a second part of the phase cycle. This property notably allows the bandwidth of the phase-shifting cells to be optimized. A phase range of 360° can in effect be segmented into two sub-ranges of around 180°. This segmentation into two sub-ranges is made possible by the complementarity of the resonant modes of the slot or microstrip type. The radiating phase-shifting cell is notably applicable to reflector arrays for an antenna designed to be installed on a space craft such as a telecommunications satellite or on a terrestrial terminal for satellite telecommunications or broadcasting systems.

15 Claims, 12 Drawing Sheets

(58) Field of Classification Search
USPC ..... 343/909
See application file for complete search history.

(56) References Cited

U.S. PATENT DOCUMENTS

| | | | | |
|---|---|---|---|---|
| 8,633,866 | B2 * | 1/2014 | Sarabandi et al. | 343/909 |
| 2008/0024368 | A1 | 1/2008 | Chang et al. | |
| 2010/0085134 | A1 | 4/2010 | Lee et al. | |
| 2010/0085272 | A1 | 4/2010 | Legay et al. | |

* cited by examiner

RECONFIGURABLE RADIATING PHASE-SHIFTING CELL BASED ON COMPLEMENTARY SLOT AND MICROSTRIP RESONANCES

CROSS-REFERENCE TO RELATED APPLICATION

This application claims priority to foreign French patent application No. FR 1102786, filed on Sep. 14, 2011, the disclosure of which is incorporated by reference in its entirety.

FIELD OF THE INVENTION

The field of the invention is that of reconfigurable radiating phase-shifting cells. It is notably applicable to reflector arrays for an antenna designed to be installed on a space vehicle such as a telecommunications satellite or on a terrestrial terminal for satellite telecommunications or broadcasting systems.

BACKGROUND

An antenna reflector array (or 'reflectarray antenna') comprises a set of radiating phase-shifting cells assembled in a one- or two-dimensional array and forming a reflecting surface allowing the directivity and gain of the antenna to be increased. The radiating phase-shifting cells of the reflector array, of the metal patch type and/or slot type, are defined by parameters able to vary from one cell to another, these parameters being for example the geometrical dimensions of the etched patterns (length and width of the patches or the slots) which are adjusted in such a manner as to obtain a desired radiation diagram.

The radiating phase-shifting cells can be formed by metal patches loaded with radiating slots and separated from a metal ground plane by a distance typically in the range between $\lambda g/10$ and $\lambda g/6$, where $\lambda g$ is the guided wavelength in the spacer medium. This spacer medium can be a dielectric material, but also a composite multilayer formed by a symmetrical arrangement of a separator of the honeycomb type and of thin-film dielectric layers. For an antenna to have a high performance, the elementary cell must be able to precisely control the phase-shift that it produces on an incident wave, for the various frequencies within the bandwidth. It is also a requirement that the process of fabrication of the reflector array be as simple as possible.

For this purpose, the applicant has previously filed a first French Patent application FR 0450575 entitled "Phase-shifting cell with linear polarization and with a variable resonant length using MEMS switches". FIG. 1 shows an embodiment of this type of phase-shifting cell CD. Its principle of operation consists in modifying the electrical length of the slot FP by placing one or more variable and controlled localized loads DC' in several different states allowing and disallowing the establishment of a short-circuit. The variation of the characteristic resonant length of the cell allows a modification of the phase-shift of the waves to be reflected. For an antenna, the waves originate from the RF source. A cell according to FIG. 1 comprises a substrate SB having a back face rigidly attached to a ground plane.

This phase-shifting cell only works for one linear polarization of the incident wave. Furthermore, the size of the cell is relatively large, of the order of $0.7\lambda$, where $\lambda$ denotes the wavelength. The mesh size of the reflector array, in other words the spatial periodicity according to which the cells are arranged in an array, is therefore much greater than $0.5\ \lambda$. This results in a non-optimal behaviour for very oblique incidences of the wave, associated with the possibility of excitation of a higher-order Floquet mode. This effect leads to a degradation of the side-lobes of the radiation diagram, also denoted by those skilled in the art as the "lobe image".

The phase-shifting cell mainly functions as a patch-type resonance modulated by the electrical length of the slot or slots. The attainment of a phase cycle greater than 360° by the modulation of this single resonance is a critical point, and certain phase states are achieved by highly resonant configurations of the phase-shifting cell. These highly resonant configurations are also characterized by higher losses, together with a higher sensitivity of the electrical characteristics to the fabrication tolerances of the cell and of the variable and controlled localized loads.

The applicant has filed a second French patent application entitled "Reflector array with optimized arrangement and antenna comprising such a reflector array". It has a phase cycle produced by phase-shifting cells having an internal structure that has a progressive development from one phase-shifting cell to another adjacent phase-shifting cell, and thus not introducing significant disruptions in periodicity over the reflecting surface. This type of cell thus avoids the interference induced in the radiation diagram by a spurious diffraction phenomenon on regions with abrupt disruptions in periodicity. FIG. 1*b* shows one example of a periodic pattern comprising a one-dimensional arrangement of several elementary radiating elements that allows a phase rotation of 360° to be obtained. It has the property of having the identical end phase-shifting cells of the phase cycle. A progressive phase cycle has also been included using a phase-shifting cell with variable and controlled localized loads.

FIG. 2 shows the layout of a radiating phase-shifting cell for such a reflector array. According to one embodiment, this phase-shifting cell takes the form of a cross with two perpendicular branches. The cross comprises three concentric annular slots 81, 82 and 83 formed in a metal patch. Variable and controlled localized loads 85 are disposed in a chosen fashion within the slots and allow the electrical length of the slots, and hence the phase of a wave reflected by the phase-shifting cell, to be varied. With several cells, it is possible to form a pattern with progressive phase variation and not comprising any abrupt transition on the surface of a reflector, by using several radiating elements having the same geometry, the same number of MEMS positioned at the same place in the annular slots, but MEMS being configured in different states. For example, with a pattern composed of several radiating elements in the form of a cross or a hexagon, having three concentric annular slots and with a MEMS in each slot, it is possible to make the phase vary progressively up to 1000° by progressively short-circuiting the various slots of the adjacent radiating elements until a radiating element having all its MEMS in the closed state is obtained, then over several additional adjacent elements, in progressively setting the MEMS in the open state until a radiating element having all its MEMS in the open state is obtained.

Although it is possible to produce a phase cycle greater than 360°, and having the same initial and final phase-shifting cell of the cycle, it is very difficult to obtain these phase states with cells having little resonance. A large number of resonant modes can potentially be excited, owing to the presence of several resonators. The appearance of these resonant modes can lead to an abrupt variation in the phase as a function of frequency. The rapid variations in the phase result in significant losses, in particular when ohmic MEMS are used, and in a sensitivity to the dispersions in fabrication of the MEMS.

SUMMARY OF THE INVENTION

One aim of the invention is to provide a phase-shifting cell with variable and controlled localized loads (micro-switches) allowing a phase-shift range to be covered with a reduced frequency variation of the phase, in other words with a more linear, more stable behaviour of the phase as a function of the frequency of the incident signal. In other words, one aim of the invention is to minimize the resonant character of the cell.

For this purpose, the subject of the invention is a radiating phase-shifting cell comprising a plurality of conducting elements formed on the surface of a substrate, above and separated from a ground plane, the said conducting elements being separated by slots, the arrangement of the slots forming an equivalent resonator whose electrical shape configures the phase-shift applied to a wave to be reflected, wherein the cell comprises controlled variable loads capable of varying the electrical length and/or width of the said slots, the conducting elements and the controlled variable loads are arranged so that, according to at least a first configuration of the said loads, a surface conductor of microwave signals is formed in order to create a resonator that is predominantly inductive, and so that, according to at least a second configuration, a slot is formed around at least one conducting element in order to create a resonator that is predominantly capacitive, the said conducting surface formed in the first configuration surrounding the said conducting element around which a slot is formed in the second configuration.

The management of the resonances of the slots and of the resonators of the microstrip type is carried out so as to preferably excite an equivalent resonance of the "slot" type in a first part of the phase cycle, and preferably an equivalent resonance of the "microstrip" type (also referred to as "patch" type) in a second part of the phase cycle. The first part of the phase cycle corresponds to a resonator whose predominant behaviour is inductive, in other words, whose equivalent resonator is more that of a parallel LC resonator than that of a series LC. The second part of the phase cycle corresponds to a resonator whose predominant behaviour is capacitive, in other words whose equivalent resonator is more that of a series LC resonator than that of a parallel LC.

The equivalent resonators of the phase-shifting cell with variable and controlled localized loads can describe a cycle similar to that shown in FIG. 1*b*. This property allows, for example, a phase cycle greater than 360° to be produced, and similar equivalent resonators to be obtained for the end values of the phase cycle.

This property also allows the bandwidth of the phase-shifting cells to be optimized. The phase range of 360°, for example, can in effect be segmented into two sub-ranges of around 180°. This segmentation into two sub-ranges is made possible by the complementarity of the resonant modes of the slot or patch type.

The minimization of the resonance results in reduced losses. The more linearly the phase varies, the wider the band over which this characteristic is obtained (as opposed to an operation of the threshold type). Bandwidths of the order of 30% can be obtained thanks to the cell according to the invention.

The periodic arrangement of the radiating phase-shifting cell according to the invention defines a reflector panel for an antenna assembly. The assembly may, furthermore, comprise several reflector panels comprising phase-shifting cells according to the invention.

Advantageously, the conducting surface on the front face is separated from the ground plane by a distance equal to a quarter of the wavelength of the incident signal. In this way, the resonances in slot mode (first configuration) and in microstrip mode (second configuration) can be separated by 180°.

According to one embodiment of the radiating phase-shifting cell according to the invention, the conducting element around which a slot is formed in the second configuration is situated substantially in the centre of the cell, the conducting elements forming the conducting surface being situated on the periphery, the said conducting surface being annular, each of the said peripheral conductors being connected to the central conductor and to the neighbouring peripheral conductors by means of controlled capacitive loads. Here, "annular" is understood to mean a slot in the form of a closed loop. The latter is formed by the interconnection of various peripheral conducting elements. Its shape may, for example, be rectangular, circular, hexagonal or any other polygonal shape, or closed curve.

The conducting elements can take the form of a cross with four branches aligned in several rows, the crosses belonging to two successive rows being offset with respect to one another, the crosses being connected by means of controlled variable capacitive loads. The shape of the conducting elements can be different, for example, square patches or regions in the shape of a disc. One advantage of conducting elements in the form of a cross is that they can be more readily interconnected.

According to another embodiment of the radiating phase-shifting cell according to the invention, the said annular conducting surface is formed by conducting strips framed by annular slots, the said strips being connected by capacitive loads capable of modifying the electrical length and/or width of interconnection slots of the said annular slots.

In other words, the cell can comprise a conducting surface in which at least two first slots are formed that are substantially concentric and spaced out from one another, the conducting surface being disposed above a ground plane, the arrangement of the slots forming an equivalent resonator whose electrical shape configures the phase-shift applied to an incident wave, the cell comprising interconnection slots connecting the said first slots together, and a plurality of controlled variable loads capable of making the electrical length and/or width of the said first slots and of the said interconnection slots vary, the said loads being activatable for configuring the cell according to a resonator substantially equivalent to a parallel LC circuit, the said loads also being activatable according to at least one other configuration for configuring the cell according to a resonator substantially equivalent to a series LC circuit.

This same phase-shifting cell may also be considered as the arrangement of resonators of the microstrip type, namely of a metal frame, an intermediate metal ring cut at several points, and a central metal patch. The connections made by variable and controlled localized loads—also referred to as micro-actuators, micro-switches or short-circuiting means—allow the electrical length and/or width of the equivalent microstrip resonator to be modified.

According to another embodiment of the cell according to the invention, the cell comprises more than two concentric slots. It comprises for example three slots, with interconnection slots between each successive concentric slot.

According to one embodiment of the radiating phase-shifting cell according to the invention, when the cell is in the first configuration, the loads connecting the peripheral conducting elements together are activated, the loads connecting the central conducting element to the peripheral conducting elements being disabled, so as to form a resonant slot whose main contribution is equivalent to that of a parallel LC circuit.

Advantageously, the loads connecting the peripheral conducting elements together are designed to take multiple values between two end values in order to be able to make the dimensions of the equivalent resonant slot vary progressively as a function of the said values.

According to one embodiment of the radiating phase-shifting cell according to the invention, when the cell is in the second configuration, the loads connecting the peripheral conducting elements together are disabled, the loads connecting the central conducting element to the peripheral conducting elements being activated, so as to form a resonant microstrip whose main contribution is equivalent to that of a series LC circuit.

Advantageously, the loads connecting the central conducting element to the peripheral conducting elements are designed to take multiple values between two end values in order to be able to vary the dimensions of the equivalent resonant microstrip progressively as a function of the said values.

According to one embodiment of the radiating phase-shifting cell according to the invention, the loads connecting the central conducting element to the peripheral conducting elements are designed to vary independently of the value of the loads connecting the peripheral conducting elements together, in such a manner that the phase-shift range applied to the incident wave is decomposed into two intervals of phase-shift, the phase-shifts applied in the first interval being obtained with a configuration of the resonant slot type, the phase-shifts applied in the second interval being obtained with a configuration of the resonant microstrip type.

According to one embodiment of the radiating phase-shifting cell according to the invention, the variable loads and the dimensions of the conducting elements are determined such that the configuration of the cell allowing the phase-shift corresponding to the first end of the phase-shift range to be applied is identical to the configuration of the cell allowing the phase-shift corresponding to the second end of the range to be applied.

According to one embodiment of the radiating phase-shifting cell according to the invention, the phase-shift range is 360°.

According to one embodiment of the radiating phase-shifting cell according to the invention, the conducting elements, the slots and the capacitive loads are disposed on the cell according to a centre of symmetry placed in the centre of the cell.

According to one embodiment of the radiating phase-shifting cell according to the invention, the capacitive loads are diodes, MEMS, or ferroelectric capacitors.

Another subject of the invention is a reflector array comprising a plurality of radiating phase-shifting cells such as described hereinabove, the said cells forming the reflecting surface of the array.

A further subject of the invention is an antenna comprising a reflector array such as described hereinabove.

BRIEF DESCRIPTION OF THE DRAWINGS

The invention will be better understood and other advantages will become apparent upon reading the description that follows, presented by way of non-limiting example and with reference to the appended figures, amongst which are.

DETAILED DESCRIPTION

Figure 3:
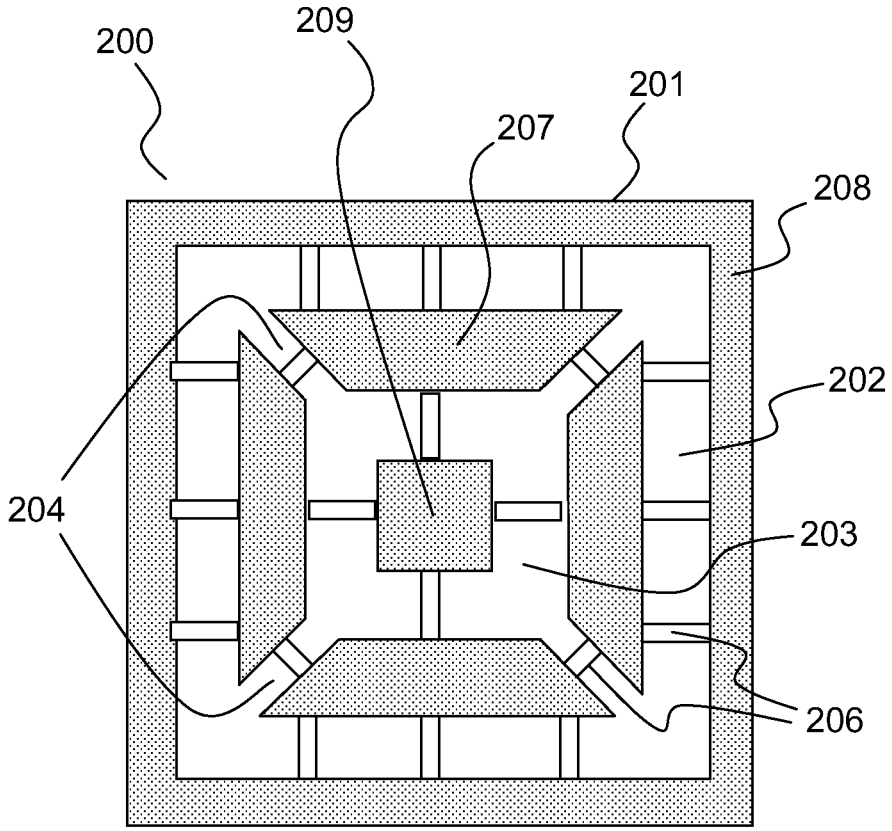
FIG. 3, one example of a layout of mechanical architecture and of positioning of variable and controlled localized loads for a radiating phase-shifting cell according to the invention, in a face view of the radiating plane of the cell.

FIG. 3 shows one embodiment of a radiating phase-shifting cell 200 according to the invention. The cell 200 comprises a planar structure such as described in the phase-shifting cells of the prior art and FIG. 3 shows the face view of the planar structure. Typically, a planar structure comprises a substrate comprising a back face rigidly attached to a ground plane and a front face. The materials used to form the substrate, the dielectric layers and the conducting layers do not limit the scope of the invention. The materials named in the documents of the prior art previously described might for example be mentioned.

The phase-shifting cell 200 preferably has a rectangular shape. However, other embodiments are possible and, by way of non-limiting example, a surface with a hexagonal shape or with a circular shape may be mentioned.

Figure 7:
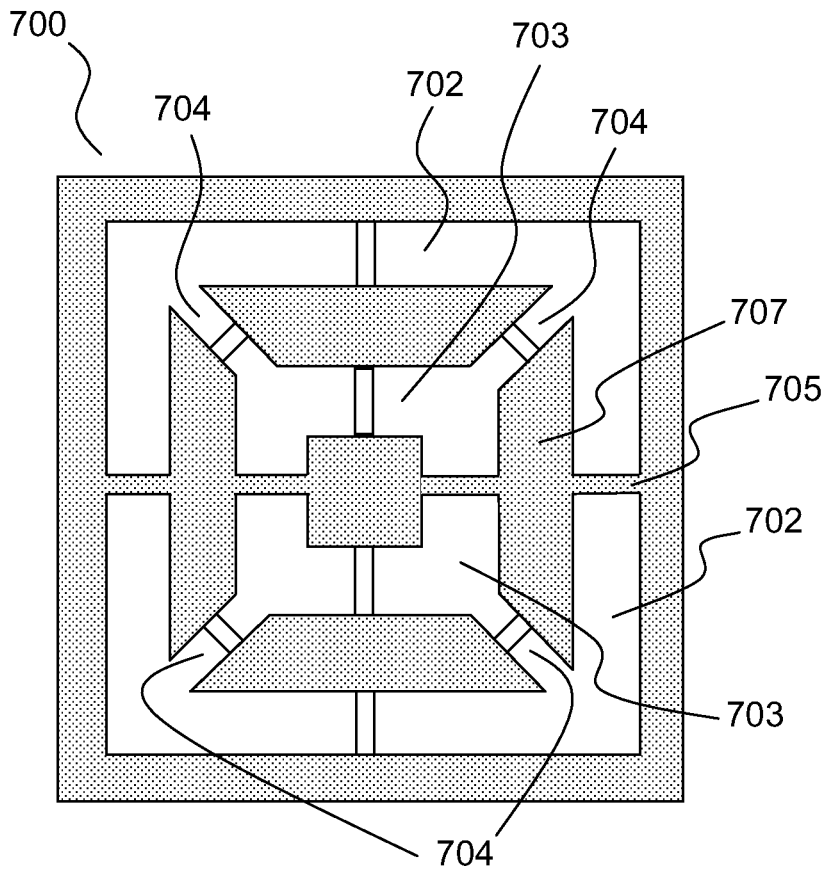
FIG. 7, another embodiment of the phase-shifting cell according to the invention.

The cell comprises at least two first slots, a first slot 202 and a second slot 203 being concentric. The first slot 202 is positioned on the outer periphery with respect to the second slot 203, in other words at a greater distance from the centre of the patch with respect to the second slot 203. The phase-shifting cell 200 can comprise two slots 202 and 203 or more, as illustrated in FIG. 3. Preferably, the slots 202 and 203 have a shape running longitudinally to the shape of the metal frame 201. Thus, the slots 202 positioned on the outer periphery of the patch surround the slots 203 on the inner periphery. If the phase-shifting cells are designed to function for only one linear polarization, it is possible to short-circuit the concentric slots by means of metal junctions 705 at a point where the electric field is zero, as illustrated in FIG. 7. This possibility is not offered when the cell is designed to function in double linear polarization mode, because at the place where the electric field is zero in the concentric slot for a linear polarization, it is at its maximum for the other orthogonal linear polarization. The periphery 201 of the cell is separated from the outer concentric slot 202 by a conducting strip 208, also denoted by the term "frame".

The slots 202 and 203 are connected by at least four interconnection slots 204. This arrangement of slots defines metal strips 207 placed in the interface between the concentric slots 201, 202. Furthermore, variable and controlled localized loads 206 are disposed at chosen places on the first slots 202 and 203, and also on the interconnection slots 204. These are for example on/off switches allowing short-circuits to be formed, or variable capacitive loads. The purpose of the switches is to modify the electrical length and/or width of the equivalent "slot" resonator or of the equivalent "microstrip" resonator.

Figure 8A:
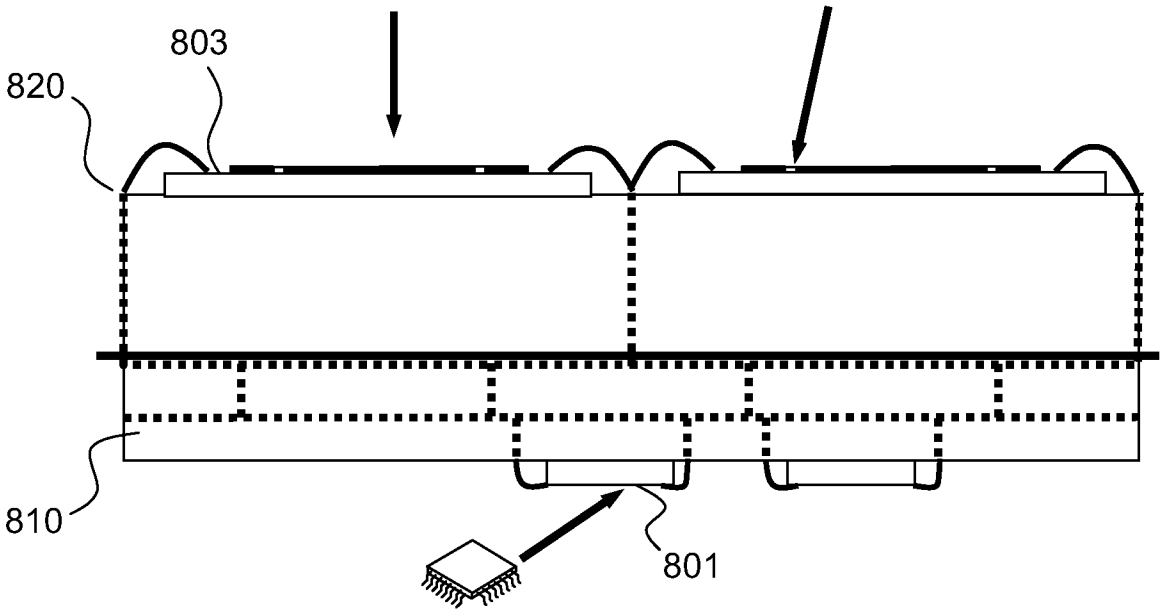
FIG. 8*a*, an illustration of a first type of device for controlling the variable loads used for reconfiguring the phase-shifting cell according to the invention.
Figure 8B:
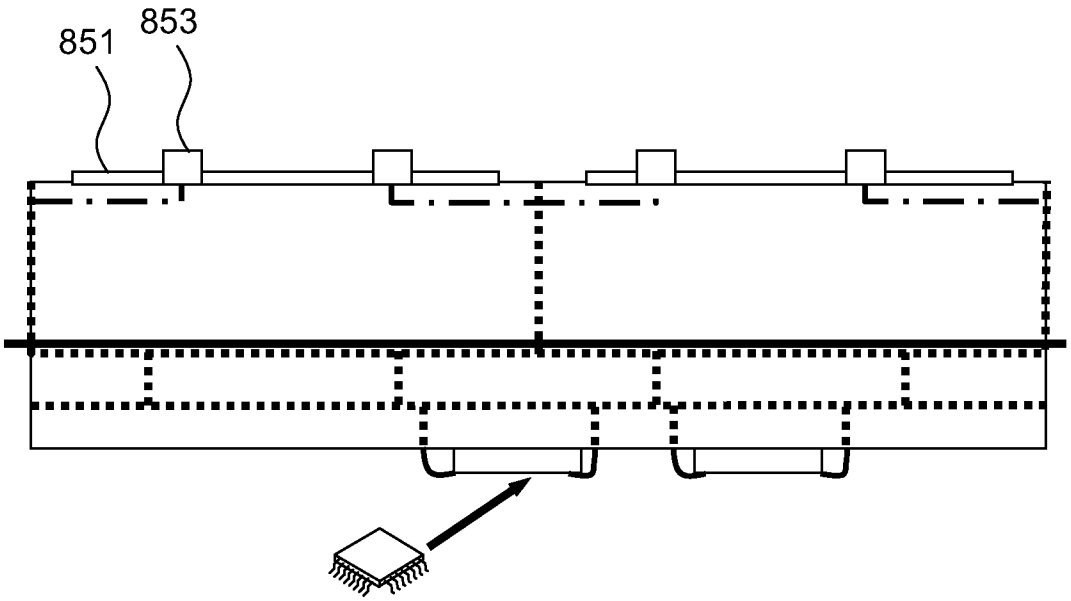
FIG. 8*b*, an illustration of a second type of device for controlling the variable loads used for reconfiguring the phase-shifting cell according to the invention.
Figure 9:
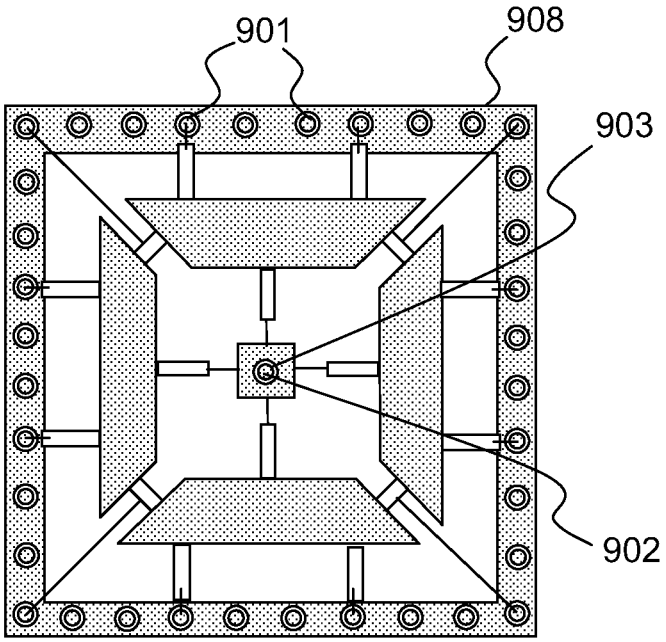
FIG. 9, one embodiment of the phase-shifting cell according to the invention in which vias are disposed for routing the control signals towards the capacitive variable loads.

According to the invention, the various variable and controlled localized loads 206 of the phase-shifting cell are controlled in order to configure the electrical length and/or width of the first slots 202 and 203 in such a manner that the equivalent resonator of the phase-shifting cell acts as a phase-shifting cell introducing a chosen phase-shift on an incident wave. The variation of the electrical length of the interconnected slots 202, 203 and 204 modifies the electrical dimensions of the equivalent slot or patch resonator. Thus, thanks to variable and controlled localized loads 206, it is possible to obtain a phase-shifting cell covering a phase-shift range of at least 360° bounded by a first end value and by a second end value. It is also possible, advantageously, to obtain a cell whose electrical shape of the equivalent resonator is identical for the first and for the second end values. Inside of the phase-shift range, the values of phase-shift for the same cell can vary in a continuous or discontinuous manner. Electronic control means, described hereinbelow with regard to FIGS. 8*a*, 8*b*, and 9, are capable of controlling the variable and controlled localized loads in such a manner as to make the phase-shift vary in a continuous or discontinuous fashion.

Two methods for modifying the electrical parameters of the slots may notably be differentiated: the first consists in disposing ON/OFF micro-switches along the slot, and to vary the length of the section of the slot included between two switches forming a short-circuit (ON). Advantageously, when the ground plane is separated from the front face of the antenna by a thickness equal to a quarter of the guided wavelength, it is then possible to cover the entirety of the 360° phase.

Figure 4:
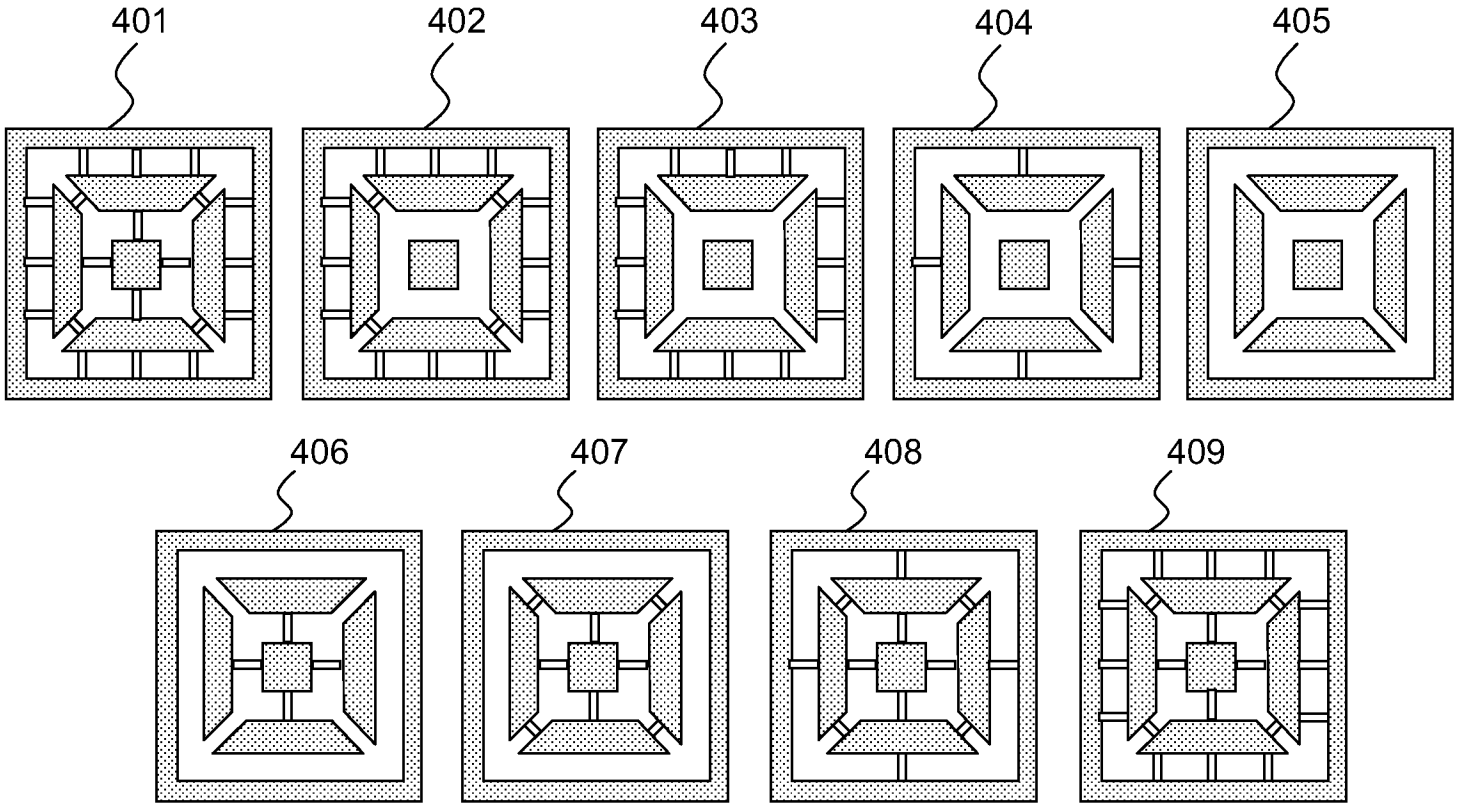
FIG. 4, an example of one cycle of radiating phase-shifting cells according to the invention covering a phase-shift range of 360°; the figure shows one example of arrangement of the mechanical architecture and of the configuration of the variable and controlled localized loads for each phase-shifting cell of the cycle.

According to the first method, the micro-switches are activated according to a progression allowing the cycle of equivalent cells to be approximated. One example is provided: the first cell 401 of the cycle illustrated in FIG. 4 is that in which all the micro-switches are in the low state. The phase-shift produced is 180°, corresponding to the response of a metallized plate. Progressively, starting from the second cell illustration 402 to the fifth cell illustration 405, the micro-switches in the centre of the cell are released in order to generate an operation equivalent to an opening in the metallized plate, whose size is increasing. Then, starting from the sixth cell illustration 406, the micro-switches are progressively re-closed from the centre, in order to obtain an operation equivalent to that of a central patch which is increasing, until the ninth illustration 409 of a configuration identical to the first cell illustration 401 is reached. With such a progression, the cycle covers a phase-shift over a range of values bounded by a first end value and by a second end value, with a configuration of the micro-switches that is identical for the first and for the second end values, without having to ensure an operation around a resonance frequency.

This first method for modification of the electrical parameters of the slots requires a significant number of micro-switches. It is possible to reduce their number and to optimize the cycle in order to cover a sufficient phase-shift range. However, if the number of micro-actuators is significantly reduced, it will not be possible to avoid the excitation of higher modes inside this cell. These higher modes allow a phase-shift to be produced, but are often associated with more significant variations of the phase with frequency. They may also induce radiation in crossed-polarization mode. The micro-switches are reconfigurable localized loads, for example of the MEMS type (acronym for Micro Electro-Mechanical System), diodes, or variable ferroelectric capacitors.

Advantageously, a phase-shifting cell producing the same phase for the two linear polarizations is invariable in rotation. This symmetry property avoids the excitation of higher modes contributing to the crossed polarization, and is also able to alter the stability of the phase in the main polarization. A minimum of four MEMS per control command must generally be used in order to meet this symmetry constraint.

Advantageously, a phase-shifting cell operating in double linear polarization mode and producing independent phases in each of the linear polarizations possesses two axial symmetries. This property prevents higher modes contributing to the crossed polarization, and also able to alter the stability of the phase in the main polarization, from being excited. Such a property requires a minimum of two MEMS to be used per control command and per polarization.

Advantageously, a cell operating in simple linear polarization mode possesses two axial symmetries. This property prevents higher modes contributing to the crossed polarization, and also able to alter the stability of the phase in the main polarization, from being excited. Such a property requires a minimum of two MEMS to be used per control command and per polarization.

Down-graded embodiments can also be implemented, for example with the aim of reducing the number of MEMS, or of increasing the number of phase states for the same number of MEMS. Thus, it is possible to vary slightly the location of the MEMS around these symmetries, or to slightly modulate the value of the capacitors formed by these MEMS disposed at the symmetrical locations.

The second method for managing the phase cycle by successively exciting an equivalent resonator of the slot type or of the patch type consists in making the capacitive loading of the slots vary. A slot is loaded by a capacitor, for example at its centre. This capacitive loading of the slot allows the velocity of the phase in the slot to be varied, and thus their resonance frequency to be modified. The variation of capacitance can be carried out by means of several digital capacitors. The concept is derived from distributed capacitive loading transmission lines or DMTL (Distributed MEMS Transmission Line).

Figure 1:
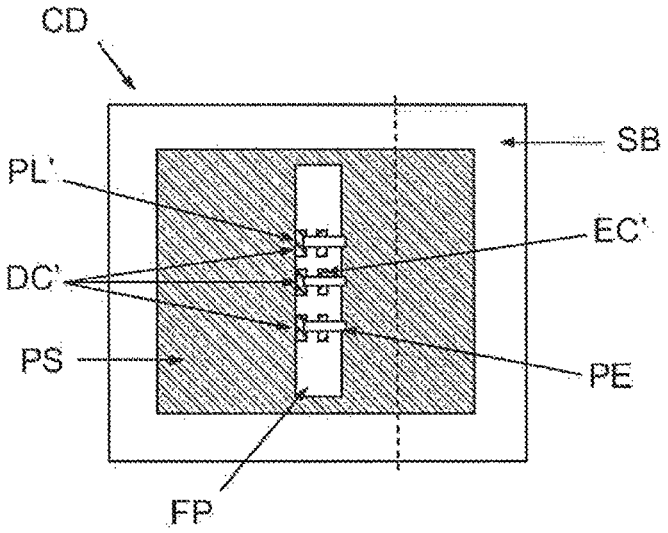
FIG.1 Prior Art
FIG. 1 shows an embodiment of a type of phase-shifting cell CD.
Figure 2:
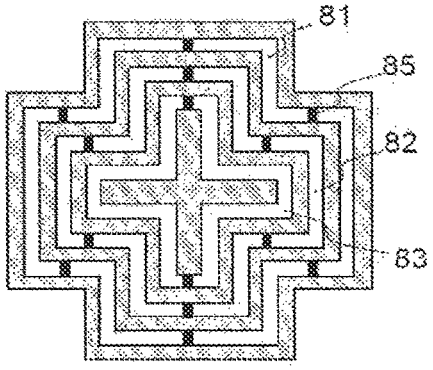
FIG.2 Prior Art
FIG. 2 shows the layout of a radiating phase-shifting cell for a reflector array.
Figure 1B:
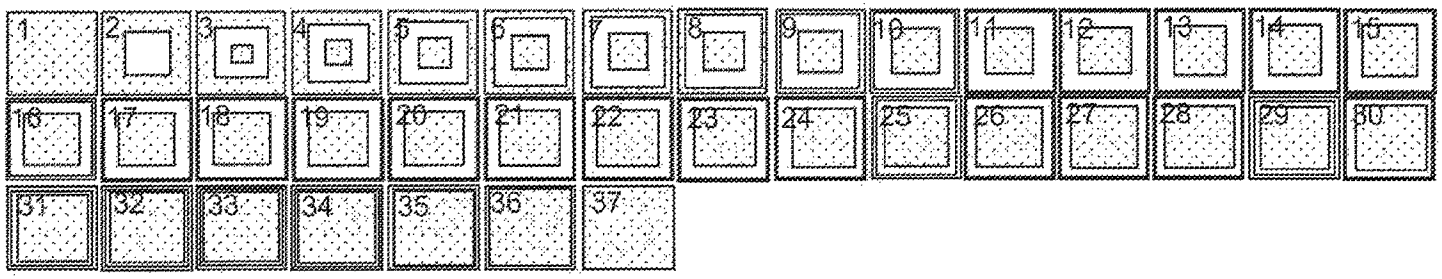
FIG.1b Prior Art
FIG. 1*b* shows one example of a periodic pattern comprising a one-dimensional arrangement of several elementary radiating elements that allows a phase rotation of 360° to be obtained.

One example of progression is presented hereinafter with regard to FIGS. 6*a* and 6*b*. In a first part of the phase cycle, illustrated in FIG. 6*a*, the interconnection slots are not loaded. On the other hand, the capacitive loads of the concentric slots are varied. The phase-shifting cell operates in the same manner as a slot whose electrical length and width parameters are varied. In a second part of the cycle, illustrated in FIG. 6*b*, the concentric slots are non-resonant. The capacitive loads for the interconnection slots are varied, thus connecting the four strip pieces 207 (cf. FIG. 2) of the intermediate microstrip ring. The phase-shifting cell functions in the same way as a microstrip resonator whose electrical length and width parameters are varied.

In the case where variable capacitive loads are employed for short-circuiting the slots, these loads can be formed by means of a micro-switch in series with a capacitor. The usual values of the loading capacitors allowing the slot resonances to be modified are between 20 and 200 fF for an operation around 10 GHz. Nevertheless, variable capacitors are not always readily formed, and it is possible to cause the capacitance to vary in digital increments. In this case, the load is composed of several capacitors in parallel connected to a switch.

As illustrated in FIG. 4, the phase-shift range of 360° optionally starts and ends with an identical equivalent resonator. The cell according to the invention can thus cover a range of 360° by a closing of the shape of the equivalent resonator. Thus, a reflecting surface can be composed of several periodic patterns, a pattern being composed of several adjacent phase-shifting cells each configuring a nearby phase-shift, in order to avoid a significant rupture in the shape of the equivalent resonator of two adjacent cells. This reduces the spurious lobes formed in the reflected beam by the reflecting surface. The electrical dimensions of the equivalent resonator depend on the electrical length and/or on the electrical width of the slots 202 and 203. Computing and control means designed for the control of the localized variable loads of the cells of the reflecting surface allow the desired phase-shift to be configured. According to another embodiment, the equivalent resonator does not take a closed-loop form; in other words, the phase-shift range of 360° can start and end with two different configurations.

Figure 5A:
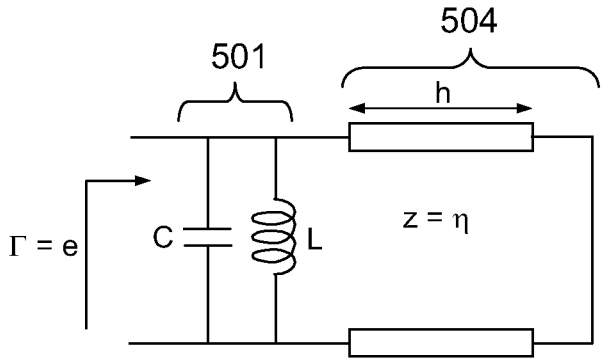
FIG. 5*a*, a representation of the equivalent resonator when the phase-shifting cell according to the invention is in "slot" resonance mode.

In the first sub-range, a resonance of the slot type is excited, an equivalent layout of which is shown in FIG. 5*a*. In this first sub-range, the phase-shifting cell behaves with respect to the incident wave as a parallel LC circuit 501.

Figure 5B:
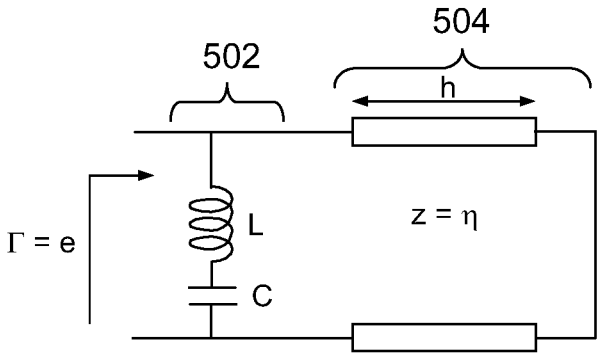
FIG. 5*b*, a representation of the equivalent resonator when the phase-shifting cell according to the invention is in "microstrip" resonance mode.

In the second sub-range, a resonance of the microstrip type is excited, whose equivalent layout is shown in FIG. 5*b*. In this second sub-range, the phase-shifting cell behaves with respect to the incident wave as a series LC circuit 502. The ground plane separated from the conducting surface on the front face can be represented by a transmission line 504.

In summary, the phase-shifting cell with double resonance is equivalent to two parallel LC circuits 503, 505 placed in series. Depending on the values of the inductive and capacitive parameters, the cell can be placed in a "slot" mode, as illustrated in FIGS. 5*a* and in the configurations 402, 403, 404, 405 in FIG. 4, or in a "patch" mode, as illustrated in FIG. 5*b* and in the configurations 406, 407, 408, 409, 401.

The phase-shifting cell according to the invention offers a significant advantage with respect to a phase-shifting cell of the prior art, based on a single resonance (of the slot type or of the microstrip type). Indeed, for a cell of the prior art, an excursion of 360° can only be performed by modifying the electrical length and width parameters of the resonator. This constraint leads to very resonant behaviours. By using the fact that the cell is based on complementary slot and microstrip resonances operating over reduced ranges, the resonance constraints are significantly reduced, and it is thus possible to significantly widen the bandwidth of the phase-shifting cell.

Figure 5C:
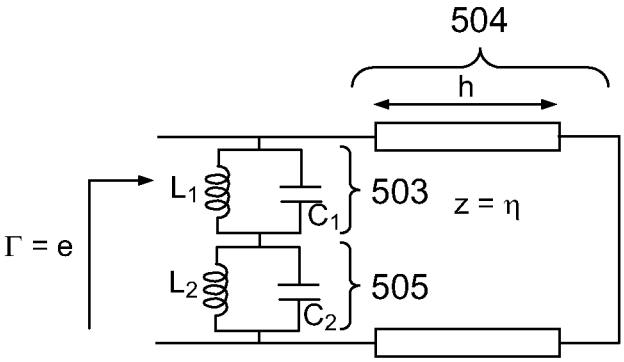
FIG. 5*c*, an electrical model of the phase-shifting cell according to the invention.

FIG. 5*c* shows an equivalent layout of the phase-shifting cell according to the invention. Depending on the configuration of the reconfigurable loads of the cell, the latter can adopt a behaviour close to the "slot" configuration illustrated in FIG. 5*a*, or a behaviour close to the "microstrip" configuration illustrated in FIG. 5*b*.

Figure 6B:
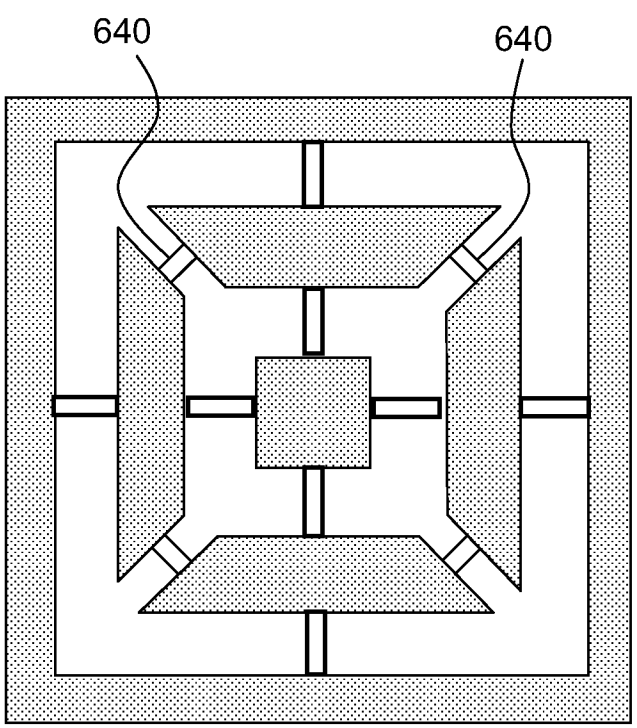
FIGS. 6*a* and 6*b*, phase-shifting cells according to the invention using capacitive MEMS.
Figure 6A:
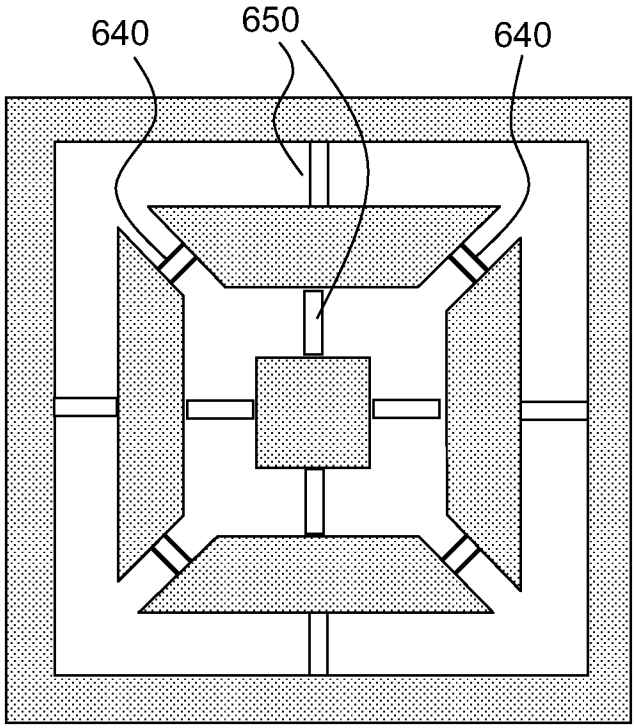

FIG. 6*a* and FIG. 6*b* show phase-shifting cells according to the invention using capacitive MEMS. FIG. 6*a* shows the case where the interconnection slots 640 are lightly loaded and where the capacitive loads of the slots 650 are varied. The cell in such a configuration is equivalent to a resonator of the slot type whose electrical length and width is varied. FIG. 6*b* shows the case where the interconnection slots 640 are loaded from the capacitive point of view and where the capacitive loads of the slots are varied. The cell in such a configuration is equivalent to a "microstrip" resonator whose electrical length and width is varied.

According to the embodiment in FIG. 7, the radiating phase-shifting cell 700 has a rectangular shape with four first slots 702 and 703 and four second slots 704. Two first slots 702 and 703, interconnected by two second slots 704, are positioned in a first half of the conducting surface 708. The other two first slots 702 and 703, interconnected by the other two second slots 704, are positioned in the second half of the conducting surface of the patch. The first slots 702 and 703 have a physical width chosen advantageously to be of the same order as that of the intermediate metal strips 707. Nevertheless, according to other embodiments, the widths of the slots 702 and 703 and of the intermediate metal strips 707 can be different.

The phase-shifting cell 700 in FIG. 7 is particularly well adapted to the reflection of linearly polarized incident waves. A portion 705 of the conducting layer separates the first slots 702 and 703 of the upper half of the first slots 702 and 703 of the lower half of the patch.

The routing of the control signals to the micro-switches disposed on a phase-shifting cell also poses a problem. This routing must not interfere with the radiation from the reflector array. Advantageously, the invention provides an answer to the solution of this problem.

As illustrated in FIG. 8*a*, in order to limit the routing constraints, a distributed control architecture is provided. The control information is for example digitally transmitted to a specialized integrated circuit (ASIC) 801, placed close to the controlled variable loads, on the back face 810 of the antenna panel. This circuit transforms the information received into a control signal adapted to each controlled load. One difficulty therefore consists in routing these control signals from the back face to each load situated on the front face 820 of the reflector array, while not interfering with the electromagnetic operation of the radiating cells.

In a first embodiment, illustrated in FIG. 8*a*, the panel is composed of a multilayer dielectric substrate on whose front face the radiofrequency (RF) chips that comprise the metal pattern of the cell and the MEMS are mounted. These RF chips are then referred to as monolithic chips and, for example, made of quartz, fused silica or alumina. The dielectric substrate, made for example of RO 4003, performs the function of a spacer between the RF chips 803 and the ground plane, and enables the through-connection of the control signals to the DC chips mounted on the back face of the substrate. The routing of the control signals on the front face is then carried out within the RF chips. Microelectronics processing can be used in order to form the resistive lines, at least in sections, at the place where these lines meet slots.

In a second embodiment illustrated in FIG. 8*b*, the panel is composed of a multilayer dielectric substrate on which the metal pattern 851 of the cell is etched, and on which MEMS components 853 are mounted; this is then a hybrid design.

As illustrated in FIG. 9, control vias 901 can be disposed at the periphery of the cell (within the frame 908), or at its centre, without fundamentally altering its operation. In addition, the periodic arrangement of metal through vias on the periphery could have the same effect as a peripheral metal wall connecting the frame 908 and the ground plane. Several of these vias could then be used for routing control signals from the back face to the front face. It is also possible to connect the central patch of the cell 903 to the ground plane by a metal through via without significantly modifying its electrical behaviour. A control via 902 can therefore also be installed at this location. When this via is used for the control, it must be insulated from the pattern in order to avoid any risk of electrical short-circuit.

One difficulty then consists in routing this control signal on the front face without altering the operation of the phase-shifting cell. If the technology allows very resistive lines (typically 10 kΩ/□) to be formed, the control commands can be routed to the MEMS without any particular precautions. The control tracks can for example pass through resonant slots without altering their behaviour. It may however also be recommended to only use these resistive lines in moderation, so that the total impedance of the line does not become too high. This is the case for example if a diagnostic device is used, allowing it to be verified whether the micro-switch has been correctly activated or not. In this case, the control line could be resistive in sections, these sections corresponding to where it passes through the slots.

Figure 10:
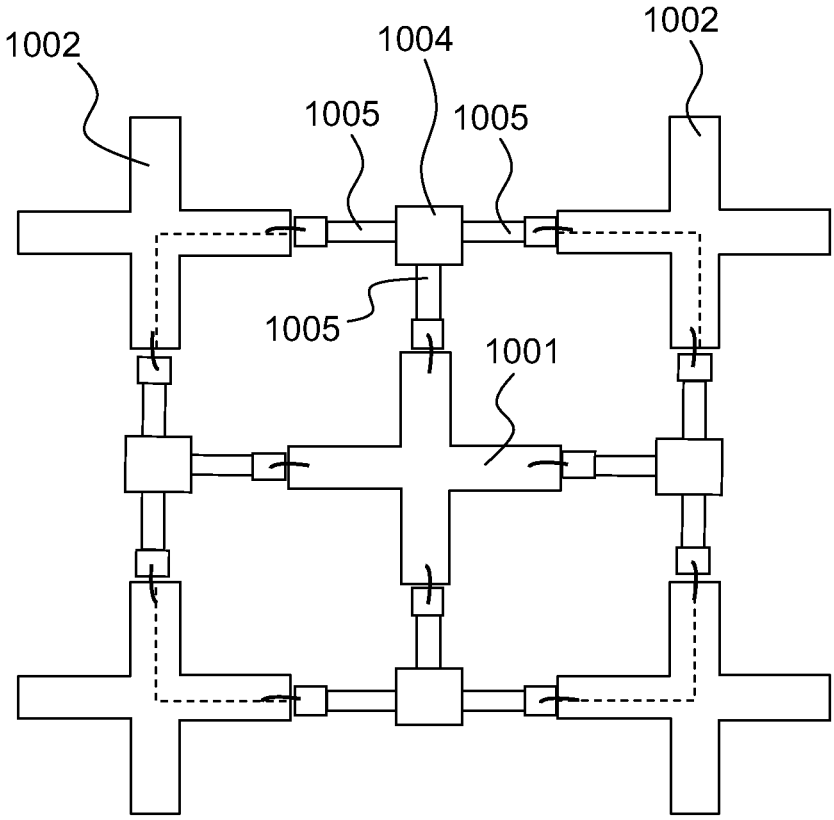
FIG. 10, another embodiment of a radiating phase-shifting cell according to the invention.

FIG. 10 shows another embodiment of a radiating phase-shifting cell according to the invention. The cell comprises a plurality of conducting elements 1001, 1002 in the form, for example, of patterns printed onto a dielectric substrate. The cell comprises a central conducting element 1001 and four peripheral conducting elements 1002 placed around this first conducting element 1001, the centres of the four peripheral conducting elements 1002 forming a square at the centre of which the central conducting element 1001 is placed. Interconnection conducting elements 1004 are inserted between each of the conducting elements 1001, 1002.

The conducting elements 1001, 1002 are connected with the interconnection conducting elements 1004 via variable and controlled capacitive loads 1006.

Owing to its reduced dimensions, a conducting element 1001 does not, on its own, allow a resonant mode to be created. It is the interconnection of these conducting elements which may allow such a mode to be established.

In the example, each conducting element has a pattern in the form of a cross with four orthogonal branches, so that, for aligned conducting elements, the ends of the branches of the crosses belonging to two adjacent crosses are close together and easily connectable by an interconnection conducting element 1004.

Variable and controlled capacitive loads 1005 are disposed in the interface between the interconnection conducting elements 1004 and the ends of the branches of the crosses forming the conducting elements 1001, 1002.

Figure 11:
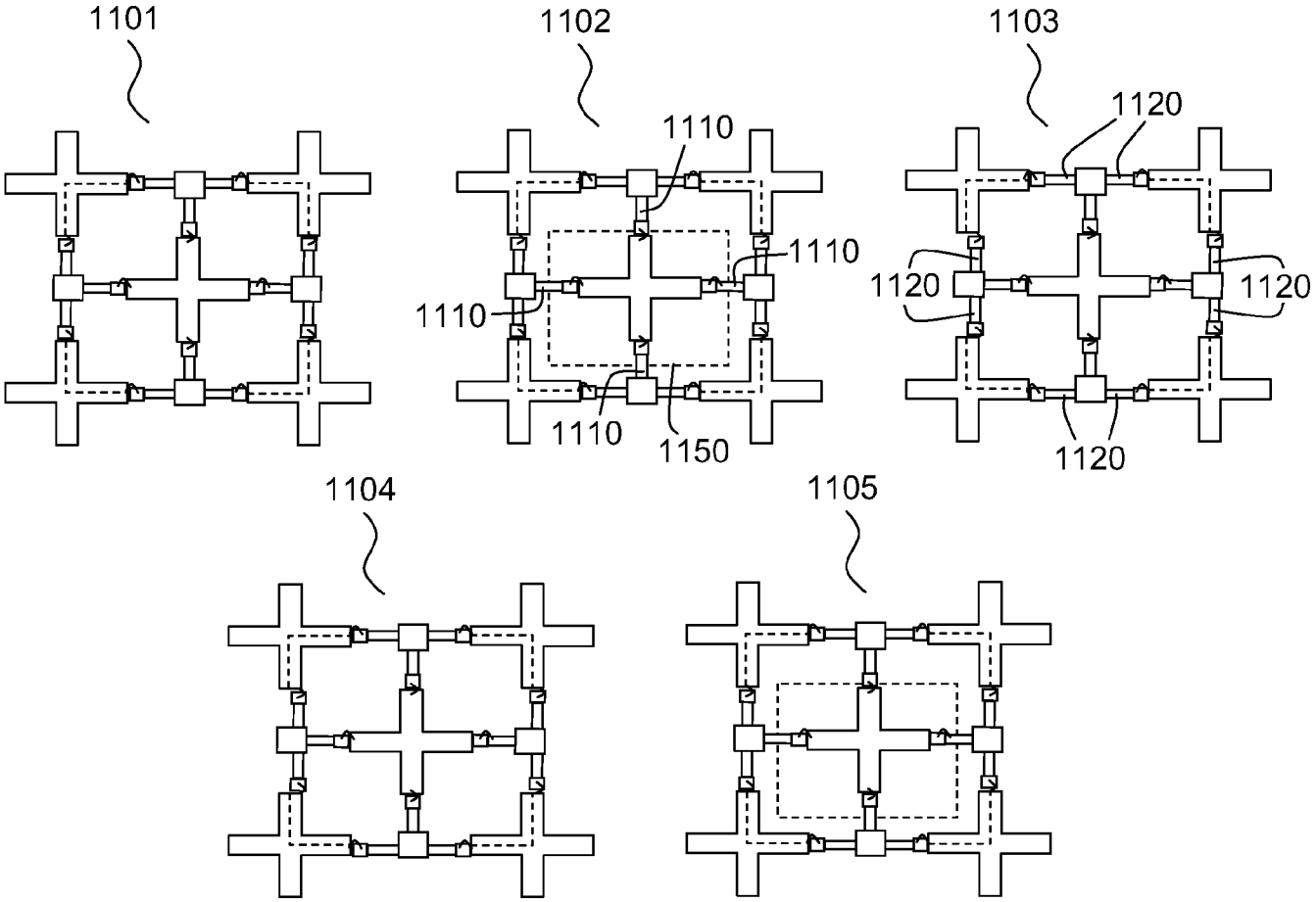
FIG. 11, a plurality of configurations adopted successively by the same phase-shifting cell such as that shown in FIG. 10.

FIG. 11 illustrates a plurality of configurations successively adopted by the same phase-shifting cell such as that shown in FIG. 10.

In a first configuration 1101, the cell behaves as a full metal patch. All the conducting elements are connected via capacitive loads. This first configuration 1101 can, for example, be used in order to apply a phase-shift of around 180° to the incident wave.

In a second configuration 1102, the central capacitive loads 1110—those which in the example are placed in the interface between the central conducting element and the interconnection conducting elements—are decreased, so that the cell behaves as an opening in the ground plane, in other words as an annular slot 1150; the cell has an inductive behaviour. This second configuration 1102 can correspond to a phase-shift that progressively moves away from 180° to reach, for example, around 80° when the central capacitors are totally unloaded.

In a third configuration 1103, the peripheral capacitive loads 1120—in other words those which in the example are placed in the interface between the peripheral conducting elements and the interconnection conducting elements—are decreased, so that the inductive behaviour is attenuated in favour of a capacitive behaviour of the radiating cell. This third configuration 1103 can correspond to a variation in the phase-shift in the range between 80° (second configuration 1102) and −20° when the peripheral capacitors are totally unloaded.

In a fourth configuration 1104, the central capacitive loads 1110 are increased, whereas the peripheral capacitive loads remain unloaded. In this fourth configuration 1104, the cell has a capacitive behaviour. This fourth configuration 1104 can correspond to a variation in the phase-shift in the range between −20° and −50°.

In a fifth configuration 1105, the central capacitive loads are increased until the state of the first configuration 1101 is reached, where this configuration can correspond, in the example, to a phase-shift applied to the incident signal between −50° and −180°. The cell returns to its initial state corresponding to a full metal patch.

Figure 12:
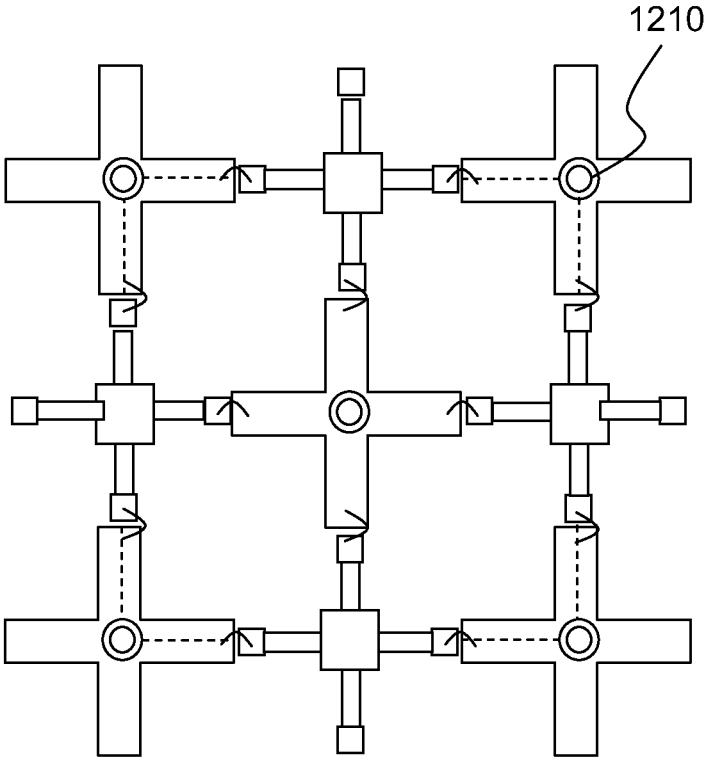
FIG. 12, one example of a means for routing the control signals towards a phase-shifting cell such as that in FIG. 10.

FIG. 12 illustrates means for routing the control signals towards a phase-shifting cell such as that in FIG. 10.

Vias 1210 are formed at the centres of the crosses forming the conducting elements. The routing of the control commands can be carried out at a level below that of the surface of the cell.

The phase-shifting cell according to the invention offers several advantages with respect to the solutions of the prior art.

A first advantage is that the phase-shifting cell is able to exhibit two complementary resonances: a first resonance by an equivalent resonator of the slot type and a second resonance by an equivalent resonator of the patch type. This allows the presence of highly resonant modes to be avoided, and thus the sensitivity of the cells to variations in frequency to be limited. The phase value thus varies in a much more linear manner as a function of the frequency of the source signal, thus avoiding abrupt jumps in phase. The phase-shifting cell according to the invention is usable over a broader frequency band (for example 30% of band).

A second advantage is the reduction in the spurious effects of a reflector array, such as described in the Patent application FR 0450575, owing to the fact that there is no appreciable rupture between two adjacent cells forming the reflector array. This is possible thanks to the possibility of covering a phase-shift range of 360° by a control cycle of the localized variable loads allowing the frequency variation of the phase to be minimized.

Thanks to the invention, it is possible to design a reflector array for an antenna whose surface is covered with radiating phase-shifting cells according to the invention. The latter are controlled so as to introduce a chosen phase-shift onto an incident wave, each of the adjacent cells being controlled in such a manner that the equivalent resonator is in a configuration close to that of an adjacent cell. The invention is notably applicable to antennas with reflector array onboard a mobile craft, such as for example an antenna of a telecommunications satellite.

The cell can be used in satellite panels designed to be used in Ku band or in Ka band, both in transmission and in reception. By way of example, the phase-shifting cells according to the invention can be employed around 20 GHz for the transmission and around 30 GHz for the reception.

The invention claimed is:

1. A radiating phase-shifting cell comprising:

a plurality of conducting elements formed on a surface of a substrate, above and separated from a ground plane and situated on a periphery, each conducting element being positioned symmetrically around and connected to at least one central conducting element and to neighbouring conducting elements on the periphery by controlled variable capacitive loads, the conducting elements being separated by radially-oriented slots, an arrangement of the slots forming an equivalent resonator whose electrical shape configures a phase-shift applied to a wave to be reflected, wherein the radiating phase-shifting cell comprises the controlled variable capacitive loads, which are capable of varying at least one of an electrical length and of an electrical width of the slots, wherein the conducting elements and the controlled variable capacitive loads are arranged so that, according to at least a first configuration of the controlled variable capacitive loads, a surface conductor of microwave signals is formed to create a resonator that is predominantly inductive, and so that, according to at least a second configuration, the slots are formed around the at least one central conducting element to create a resonator that is predominantly capacitive, and a conducting surface formed by the plurality of conducting elements arranged around the at least one central conducting element and being separated from each other by the slots to not completely encircle the at least one central conducting element.

2. The radiating phase-shifting cell according to claim 1, wherein the conducting elements take a form of a cross with four branches aligned in several rows, the crosses belonging to two successive rows being offset with respect to one another, the cross being connected by means of controlled variable capacitive loads.

3. The radiating phase-shifting cell according to claim 1, wherein the conducting surface is formed by conducting strips surrounded by annular slots, the conducting strips being connected by capacitive loads capable of modifying at least one of the electrical length and the electrical width of interconnection slots of the annular slots.

4. The radiating phase-shifting cell according to claim 1, wherein, when the radiating phase-shifting cell is in the first configuration, the controlled variable capacitive loads connecting the peripheral conducting elements together are activated, the controlled variable capacitive loads connecting the central conducting element to the peripheral conducting elements being disabled, to form a resonant slot whose main contribution is equivalent to that of a parallel LC circuit.

5. The radiating phase-shifting cell according to claim 4, wherein the controlled variable capacitive loads connecting the peripheral conducting elements together are designed to take multiple values between two end values to be able to make dimensions of an equivalent resonant slot vary progressively as a function of the values.

6. The radiating phase-shifting cell according to claim 1, wherein, when the radiating phase-shifting cell is in the second configuration, the controlled variable capacitive loads connecting the peripheral conducting elements together are disabled, the controlled variable capacitive loads connecting the central conducting element to the peripheral conducting elements being activated, to form a resonant microstrip whose main contribution is equivalent to a series LC circuit.

7. The radiating phase-shifting cell according to claim 6, wherein the controlled variable capacitive loads connecting the central conducting element to the peripheral conducting elements are designed to take multiple values between two end values to be able to vary dimensions of an equivalent resonant microstrip progressively as a function of the values.

8. The radiating phase-shifting cell according to claim 1, wherein the controlled variable capacitive loads connecting the central conducting element to the peripheral conducting elements are designed to vary independently from a value of the loads connecting the peripheral conducting elements together, in such a manner that a phase-shift range applied to an incident wave is decomposed into two intervals of phase-shift, the phase-shifts applied in the first interval being obtained with a configuration of a resonant slot type, the phase-shifts applied in the second interval being obtained with a configuration of a resonant microstrip type.

9. The radiating phase-shifting cell according to claim 1, wherein the controlled variable capacitive loads and dimensions of the conducting elements are determined such that a configuration of the radiating phase-shifting cell allowing a corresponding phase-shift to be applied to a first end of a phase-shift range is identical to configuration of the radiating phase-shifting cell allowing a corresponding phase-shift to be applied to a second end of the phase-shift range.

10. The radiating phase-shifting cell according to claim 1, wherein a phase-shift range is 360°.

11. The radiating phase-shifting cell according to claim 1, wherein the conducting elements, the slots and the controlled variable capacitive loads are disposed on the cell according to a center of symmetry placed in the center of the cell.

12. The radiating phase-shifting cell according to claim 1, wherein the controlled variable capacitive loads are diodes, Micro-Electro-Mechanical Systems (MEMS), or ferroelectric capacitors.

13. A reflector array comprising a plurality of radiating phase-shifting cells according to claim 1, the radiating phase shifting cells forming a reflecting surface of the reflector array.

14. An antenna comprising a reflector array according to claim 13.

15. A reflector array antenna comprising:

a plurality of radiating phase shifting cells forming a reflecting surface of the reflector array, wherein each said radiating phase shifting cell comprises a plurality of conducting elements formed on a surface of a substrate, above and separated from a ground plane and situated on a periphery, each conducting element being positioned around and connected to at least one central conducting element and to neighboring conducting elements on the periphery by controlled variable capacitive loads, the plurality of conducting elements being separated by slots, an arrangement of the slots forming an equivalent resonator whose electrical shape configures a phase-shift applied to a wave to be reflected, wherein each said radiating phase shifting cell comprises the controlled variable capacitive loads, which are capable of varying at least one of an electrical length and of an electrical width of the slots, the plurality of conducting elements, the slots and the controlled variable capacitive loads being disposed on the cell according to a center of symmetry placed in the center of the cell and being arranged so that, according to at least a first configuration of the controlled variable capacitive loads, a surface conductor of microwave signals is formed to create a resonator that is predominantly inductive, and so that, according to at least a second configuration, the slots are formed around the at least one central conducting element to create a resonator that is predominantly capacitive, and a conducting surface formed by the plurality of conducting elements surrounded by the slots surrounding the at least one central conducting element and being separated from each other by portions of the slots having a radial orientation with respect to the at least one central conducting element.

* * * * *